US007892056B2

(12) United States Patent
Okabe et al.

(10) Patent No.: US 7,892,056 B2
(45) Date of Patent: Feb. 22, 2011

(54) WATER COOLING APPARATUS IN POWER TRANSMISSION SYSTEM OF BOAT PROPULSION UNIT

(75) Inventors: Yoshihiko Okabe, Shizuoka (JP); Hirotoshi Yamaguchi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 184 days.

(21) Appl. No.: 12/345,790

(22) Filed: Dec. 30, 2008

(65) Prior Publication Data

US 2009/0173185 A1 Jul. 9, 2009

(30) Foreign Application Priority Data

Jan. 9, 2008 (JP) ..... 2008-002656

(51) Int. Cl.

| | |
|---|---|
| ***F01M 5/00*** | (2006.01) |
| ***F02B 61/04*** | (2006.01) |
| ***F01P 3/20*** | (2006.01) |
| ***F28F 9/02*** | (2006.01) |
| ***F28F 9/04*** | (2006.01) |
| *B63H 21/34* | (2006.01) |

(52) U.S. Cl. ..... 440/88 D; 440/88 C; 440/88 HE

(58) Field of Classification Search ..... 440/88 R, 440/88 C, 88 K, 49, 75, 88 D, 88 HE See application file for complete search history.

(56) References Cited

U.S. PATENT DOCUMENTS

| | | | | |
|---|---|---|---|---|
| 7,409,930 | B2 * | 8/2008 | Nagashima et al. | 123/41.33 |
| 7,497,750 | B2 * | 3/2009 | Nakata et al. | 440/88 C |
| 2008/0070739 | A1 | 3/2008 | Nakamura et al. | |
| 2008/0233815 | A1 | 9/2008 | Nakamura et al. | |

FOREIGN PATENT DOCUMENTS

| | | | |
|---|---|---|---|
| WO | 2007/007707 | A1 | 1/2007 |

* cited by examiner

*Primary Examiner*—Daniel V Venne
(74) *Attorney, Agent, or Firm*—Keating & Bennett, LLP

(57) ABSTRACT

A water cooling apparatus in a power transmission system of a boat propulsion system includes a transmission unit that changes the speed of an output from an engine and then transmits the output to a propeller shaft. The transmission unit includes a cylindrical transmission case with an axis extending vertically, a transmission device housed in the transmission case and arranged to change the speed of an input, and a cooling water passage formed in the transmission case for flowing cooling water. In the plan sectional view of the transmission unit, the cooling water passage is formed in at least one of a side portion or a rear portion of the transmission case. As a result, strain on a rear portion of a hull that supports a boat propulsion unit is prevented and minimized, while a transmission unit is sufficiently cooled with cooling water.

9 Claims, 15 Drawing Sheets

| Component (Reference numeral) | ○: Clutch engaged ×: Clutch disengaged | | | | |
|---|---|---|---|---|---|
| First clutch (66) | × | ○ | × (○) | × | ○ |
| Second clutch (67) | × | × | × | ○ | ○ |
| Third clutch (68) | ○ | ○ | × | × | × |
| One-way clutch (75) | Inhibition of reverse rotation | Permission of forward rotation | Inhibition of reverse rotation (Permission of forward rotation) | Inhibition of reverse rotation | Permission of forward rotation |
| Speed change state | Slow forward travel | Fast forward travel | Neutral | Slow reverse travel | Fast reverse travel |

FIG. 13

WATER COOLING APPARATUS IN POWER TRANSMISSION SYSTEM OF BOAT PROPULSION UNIT

BACKGROUND OF THE INVENTION

1. Field of the Invention

The present invention relates to a power transmission system of a boat propulsion unit including a transmission unit that receives an output from an engine, changes its speed, and transmits the output to a propeller. More specifically, the present invention relates to a water cooling apparatus for cooling the transmission unit with cooling water.

2. Description of the Related Art

The above type of conventional boat propulsion unit is disclosed in WO 2007/007707, which discloses a boat propulsion unit including a case which is disposed right behind a hull and is supported at the rear of the hull, a propeller supported in a lower portion of the case, and a transmission unit housed in the case to receive an engine output, change its speed, and transmit the engine output to the propeller.

In an attempt to propel a boat, if an engine output is input to the transmission unit of the power transmission system, the speed of this input is changed to a desired state in the transmission unit based on a speed change operation by a crewmember and is transmitted to the propeller. Then, the boat travels at a speed corresponding to the speed of the propeller.

The transmission unit tends to be heated by frictional heat from a rotating body thereof during a speed change operation with the transmission unit. Such heating of the transmission unit affects the lifetime of the transmission unit.

A cooling water passage is formed in a transmission case forming an outer shell of the transmission unit to flow cooling water therein in order to prevent the transmission unit from being heated. In this case, a large amount of water is required to flow through the cooling water passage to sufficiently cool the transmission unit. Therefore, the water cooling passage is formed in the transmission case with a relatively large cross-sectional area. However, the larger cross-sectional area of the water cooling passage may outwardly expand an outer surface of the transmission case. An outer surface of the case that houses the transmission unit may also expand outward accordingly.

As described above, the case of the boat propulsion unit is disposed right behind the hull and is supported at the rear of the hull. Therefore, if the outer surface of the case expands outward as described above, the center of gravity of the boat propulsion unit tends to recede rearward from the rear of the hull in order to avoid interference of the case with the rear of the hull. As a result, the support moment by which the rear of the hull supports the boat propulsion unit increases, thereby causing a problem that strain on the rear portion of the hull increases.

SUMMARY OF THE INVENTION

In view of the problems described above, preferred embodiments of the present invention provide a water cooling apparatus in a power transmission system of a boat propulsion unit including a case supported at a rear of a hull and a transmission unit to transmit an output from an engine housed in the case to a propeller, that relieves strain on a rear portion of a hull that supports the boat propulsion unit, and allows a transmission unit to be sufficiently cooled with cooling water.

According to a preferred embodiment of the present invention, a water cooling apparatus in a power transmission system of a boat propulsion unit includes a case located right behind a hull and supported by a rear portion of the hull, a propeller supported by a lower portion of the case, and a transmission unit housed in the case and arranged to receive an output from an engine, change a speed of the output, and transmit the output to the propeller, the transmission unit including a transmission case defining an outer shell of the transmission unit with its axis extending vertically, a transmission device housed in the transmission case and arranged to change the speed of the output of the engine, and a cooling water passage formed in the transmission case for flowing cooling water, in which the cooling water passage is formed in at least one of a side portion or a rear portion of the transmission case in a plan sectional view of the transmission unit.

A total cross-sectional area of the cooling water passage in front of the axis of the transmission case preferably is smaller than a total cross-sectional area of the cooling water passage behind the axis.

The transmission unit preferably includes a pair of left and right front bolts extending vertically to fasten the front portion of the transmission case to the case and a pair of left and right rear bolts extending vertically to fasten the rear portion of the transmission case to the case, and the width dimension between the left and the right front bolts is preferably larger than the width dimension between the left and the right rear bolts in the width direction of the hull.

In a plan sectional view of the transmission unit, the cooling water passage is preferably formed on a first arc having a first radius centered at the axis, the axes of the front bolts are located on a second arc having a second radius centered at the axis, and the second radius is preferably smaller than the first radius.

An oil return passage is preferably formed in the side portion of the transmission case such that oil, which has lubricated the transmission device of the transmission unit, flows down to an oil pan formed in a lower portion of the transmission case and a cooling water passage formed in the side portion of the transmission case is located outside the oil return passage.

The oil pan and the lower end portion of the water cooling passage are preferably formed in a case bottom defining the bottom of the transmission case.

The arc of the cooling water passage around the axis of the transmission case is preferably longer than that of the oil return passage in the plan sectional view of the transmission unit.

A lower end portion of the water cooling passage preferably has a substantially annular shape to extend around the axis.

A plurality of drain holes arranged to discharge the cooling water are preferably formed in the bottom to fluidly connect the lower end portion of the cooling water passage with an area below the transmission case.

A preferred embodiment of the present invention provides a water cooling apparatus in a power transmission system of a boat propulsion unit including a case located right behind a hull and supported by a rear portion of the hull, a propeller supported by a lower portion of the case, a transmission unit housed in the case and arranged to receive an output from an engine and change a speed of the output and transmit the output to the propeller, a cylindrical transmission case defining an outer shell of the transmission unit with its axis extending vertically, a transmission device housed in the transmission case and arranged to change the speed of the output of the engine, and a cooling water passage formed in the transmission case for flowing cooling water, wherein the cooling water passage is formed in at least one of a side portion or a rear portion of the transmission case in a plan sectional view of the transmission unit.

Therefore, in the plan sectional view of the transmission unit, it is possible to prevent and minimize forward expansion of the front outer surface of the transmission case due to forming the cooling water passage in the transmission case of the transmission unit. In addition, the above-described unique structure and its advantageous effects also make it possible to prevent and minimize the forward expansion of the front outer surface of the case housing the transmission unit.

Accordingly, the center of gravity of the boat propulsion unit can be set closer to the rear portion of the hull while avoiding contact of the rear portion of the hull with the front outer surface of the case. As a result, it is possible to reduce the magnitude of the support moment generated when the rear portion of the hull supports the boat propulsion unit. As a result, it is possible to relieve strain on the rear portion of the hull.

A total cross-sectional area of the cooling water passage in front of the axis of the transmission case is preferably smaller than a total cross-sectional area of the cooling water passage behind the axis.

Therefore, if the total cross-sectional area of the cooling water passage behind the axis is increased while minimizing the total cross-sectional area of the cooling water passage in front of the axis, the amount of the cooling water flowing through the cooling water passage can be increased, thereby sufficiently cooling the transmission unit and preventing the forward expansion of the front outer surface of the transmission case. Therefore, for the same reason as above, it is possible to relieve strain on the rear portion of the hull that supports the boat propulsion unit.

The transmission unit preferably includes a pair of left and right front bolts extending vertically to fasten the front portion of the transmission case to the case and a pair of left and right rear bolts extending vertically to fasten the rear portion of the transmission case to the case, and the width dimension between the left and the right front bolts is preferably larger than the width dimension between the left and the right rear bolts in the width direction of the hull.

With the above configuration, since the left and the right front bolts can be respectively positioned in the right side portion and the left side portion of the transmission case, it is possible to prevent the forward expansion of the front outer surface of the transmission case due to the disposition of each of the front bolts. In addition, the above suppression also makes it possible to prevent the forward expansion of the front outer surface of the case housing the transmission unit. Therefore, for the same reason as above, it is possible to relieve strain on the rear portion of the hull.

In the plan sectional view of the transmission unit, the cooling water passage is preferably formed on a first arc having a first radius centered at the axis, the axes of the front bolts are located on a second arc having a second radius centered at the axis, and the second radius is preferably smaller than the first radius.

With the above configuration, since the cooling water passage can be formed on the first arc having the first large radius while avoiding interference with each of the front bolts, the cross-sectional area of the cooling water passage can further be enlarged without the forward expansion of the front outer surface of the transmission case. Therefore, it is possible to increase the amount of the cooling water that flows through the cooling water passage, thereby sufficiently cooling the transmission unit.

An oil return passage is preferably formed in the side portion of the transmission case such that oil, which has lubricated the transmission device of the transmission unit, flows down to an oil pan formed in a lower portion of the transmission case and the cooling water passage formed in the side portion of the transmission case is located outside the oil return passage.

With the above configuration, the oil in the oil return passage can be cooled directly and efficiently with the cooling water flowing through the cooling water passage. Therefore, degradation of the oil can be reliably prevented.

The oil pan and the lower end portion of the water cooling passage are formed in a case bottom defining the bottom of the transmission case.

With the above configuration, the oil collected in the oil pan can be cooled more directly and efficiently with the cooling water flowing through the lower end portion of the cooling water passage. Therefore, degradation of the oil can be reliably prevented.

In addition, as described above, the cooling water passage formed in the side portion of the transmission case is disposed outside the oil return passage.

With the above configuration, since the cooling water passage is located further away from the axis than the oil return passage, the length of the cooling water around the axis can be further extended. Therefore, due to the extended cooling water passage, it is possible to increase the amount of the cooling water that flows through the cooling water passage, thereby sufficiently cooling the oil in the oil return passage.

The arc of the cooling water passage around the axis of the transmission case is preferably longer than that of the oil return passage in the plan sectional view of the transmission unit.

With the above configuration, the cross-sectional area of the cooling water passage can further be enlarged. Therefore, it is possible to increase the amount of the cooling water that flows through the cooling water passage, thereby further sufficiently cooling the oil in the oil return passage.

The lower end portion of the water cooling passage preferably has a substantially annular shape to extend around the axis.

With the above configuration, a contact area between the cooling water flowing through the cooling water passage and the bottom can be enlarged. Therefore, the oil collected in the oil pan in the bottom can be further effectively cooled with the cooling water.

A plurality of drain holes for discharging the cooling water are preferably formed in the bottom to fluidly connect the lower end portion of the cooling water passage with an area below the transmission case.

With the above configuration, the cooling water respectively flows toward each of the drain holes from the upstream side of the cooling water passage in the lower end portion of the cooling water passage. The cooling water can thereby be prevented from flowing unevenly or stagnating in the lower end portion of the cooling water passage. Accordingly, the cooling water can flow throughout each portion of the cooling water passage. As a result, the oil in the oil pan can be further effectively cooled with the cooling water.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 13 is a diagram showing effects of the transmission unit of the first preferred embodiment of the present invention.

DETAILED DESCRIPTION OF THE PREFERRED EMBODIMENTS

In a water cooling apparatus in a power transmission system of a boat propulsion unit according to a preferred embodiment of the present invention, in order to relieve strain on the rear portion of a hull that supports a boat propulsion unit and also ensure that a transmission unit is sufficiently cooled with cooling water in a power transmission system of the boat propulsion unit including a case supported at the rear of the hull and the transmission unit to transmit an output from an engine housed in the case to a propeller, preferred embodiments for carrying out the present invention will be described below.

More specifically, a water cooling apparatus in a power transmission system of a boat propulsion unit according to a preferred embodiment of the present invention includes a case which is disposed right behind a hull and is supported at the rear of the hull, a propeller supported in a lower portion of the case, and a transmission unit housed in the case to receive an engine output, change a speed of the engine output, and transmit the engine output to the propeller. The transmission unit includes a cylindrical transmission case defining an outer shell thereof with its axis extending vertically, a transmission device housed in the transmission case for changing the speed of the input, and a cooling water passage formed in the transmission case for flowing cooling water.

In the plan sectional view of the transmission unit, the cooling water passage is formed in at least one of a side portion or a rear portion of the transmission case.

First Preferred Embodiment

In order to describe the present invention in more detail, a first preferred embodiment will be described hereinafter with reference to FIGS. 1 to 13.

Figure 1:
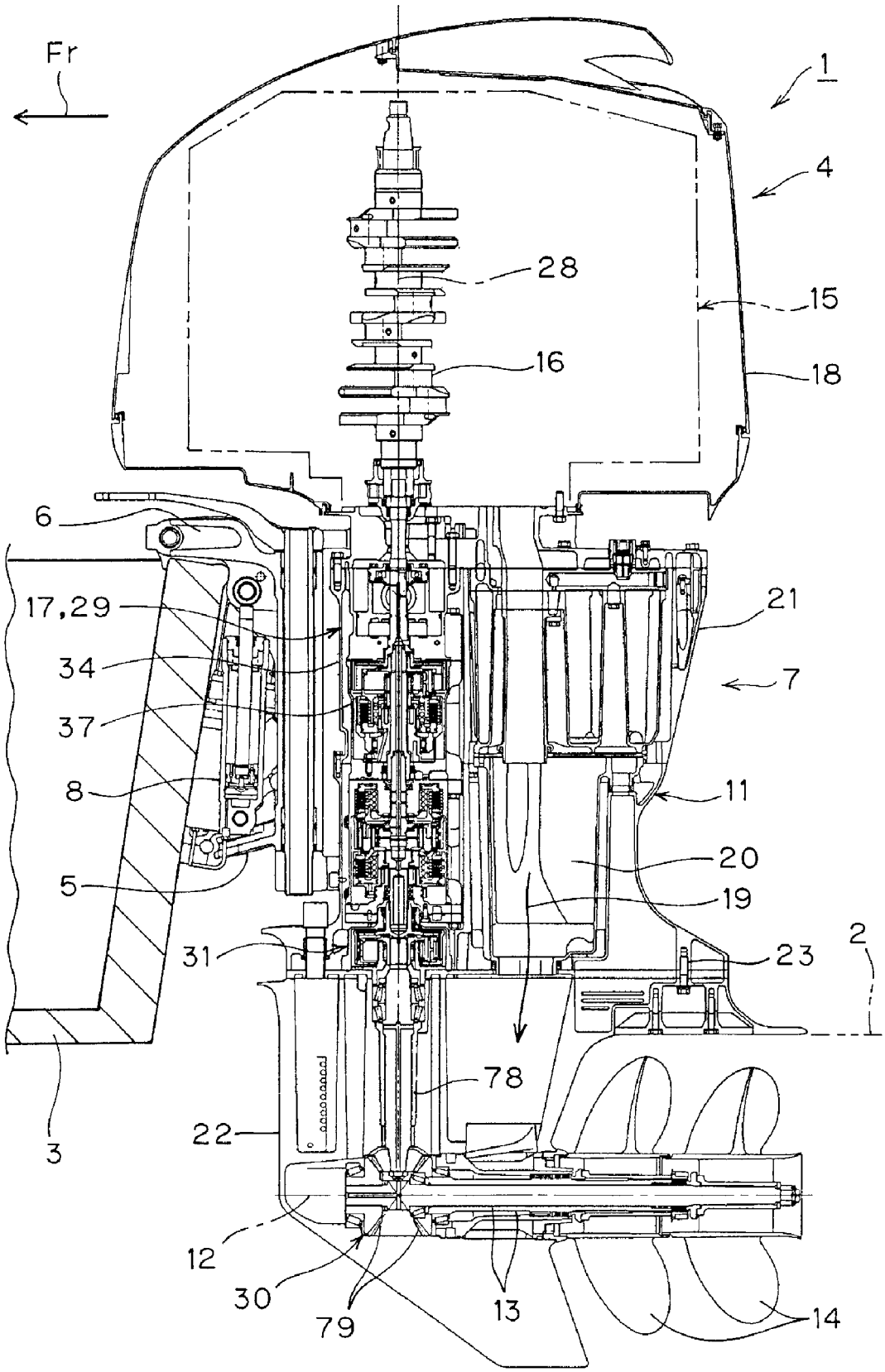
FIG. 1 is a sectional side view of a boat propulsion unit of a first preferred embodiment of the present invention in which a transmission unit is shown in a sectional view.
Figure 2:
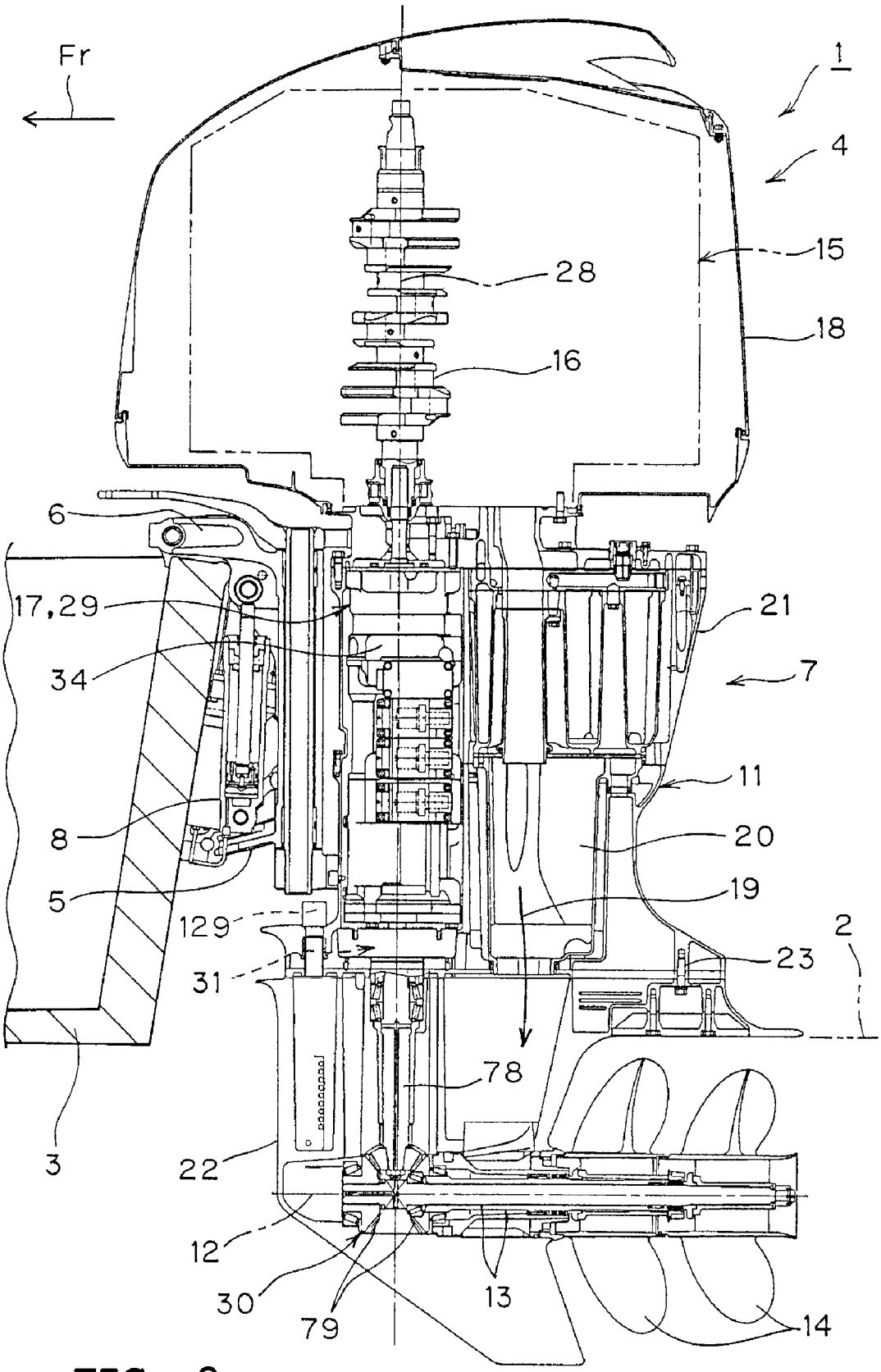
FIG. 2 is a sectional side view of the boat propulsion unit of the first preferred embodiment of the present invention in which the transmission unit is shown in outline.

In FIGS. 1 and 2, reference numeral 1 denotes a boat, and the arrow Fr indicates a forward direction in which the boat 1 is propelled. The term "right and left" described below designates a width direction of the boat 1 with respect to the forward direction.

The boat 1 includes a hull 3 capable of floating on water 2 and a boat propulsion unit 4 that is detachably supported at the rear of the hull 3 so as to propel the boat 1. The surface of the water 2 shown by a double-dashed line in FIGS. 1 and 2 indicates a water surface when the boat 1 is traveling forward. The surface of the water 2 rises slightly when the boat 1 stops.

The boat propulsion unit 4 includes a clamp bracket 5 detachably supported at the rear of the hull 3, a swivel bracket 6 pivoted by the clamp bracket 5 for fore-and-aft swinging rearward and upward, a propelling unit 7 supported by the swivel bracket 6, and a hydraulic cylinder 8 suspended between the clamp bracket 5 and the swivel bracket 6 for trimming or tilting the propelling unit 7 associated with the swivel bracket 6.

The propelling unit 7 includes a case 11 supported by the swivel bracket 6 and extending vertically with its lower end immersed in the water 2, a propeller 14 supported at the lower end of the case 11 via a propeller shaft 13 so as to rotate about an axis 12 extending in a fore-and-aft direction, an engine 15 supported on an upper surface of the case 11, a power transmission system 17 housed in the case 11 to receive an output from a crankshaft 16 of the engine 15, change its speed, select its rotation either from a forward rotation A or a reverse rotation B as a mode of transmission, and transmit it to the propeller 14, and a cowling 18 for removably covering the engine 15. The case 11 is placed right behind the hull 3.

The propeller shafts 13 and the propellers 14 are preferably both provided in pairs on the axis 12. The helical directions of the paired propellers 14 are preferably opposite to each other. When the output transmitted from the power transmission system 17 to each of the propellers 14 is in the forward rotation A, these propellers 14 rotate in the opposite directions to propel the boat 1 forwardly. On the other hand, when the output from the power transmission system 17 is in the reverse rotation B, each of the propellers 14 rotates in a reverse direction from the above direction to propel the boat 1 astern. In an open space in a portion (rear portion) of the case 11, an exhaust passage 20 is formed to emit exhaust gas 19 discharged from the engine 15 by guiding it to an area under the surface of the water 2.

Figure 6:
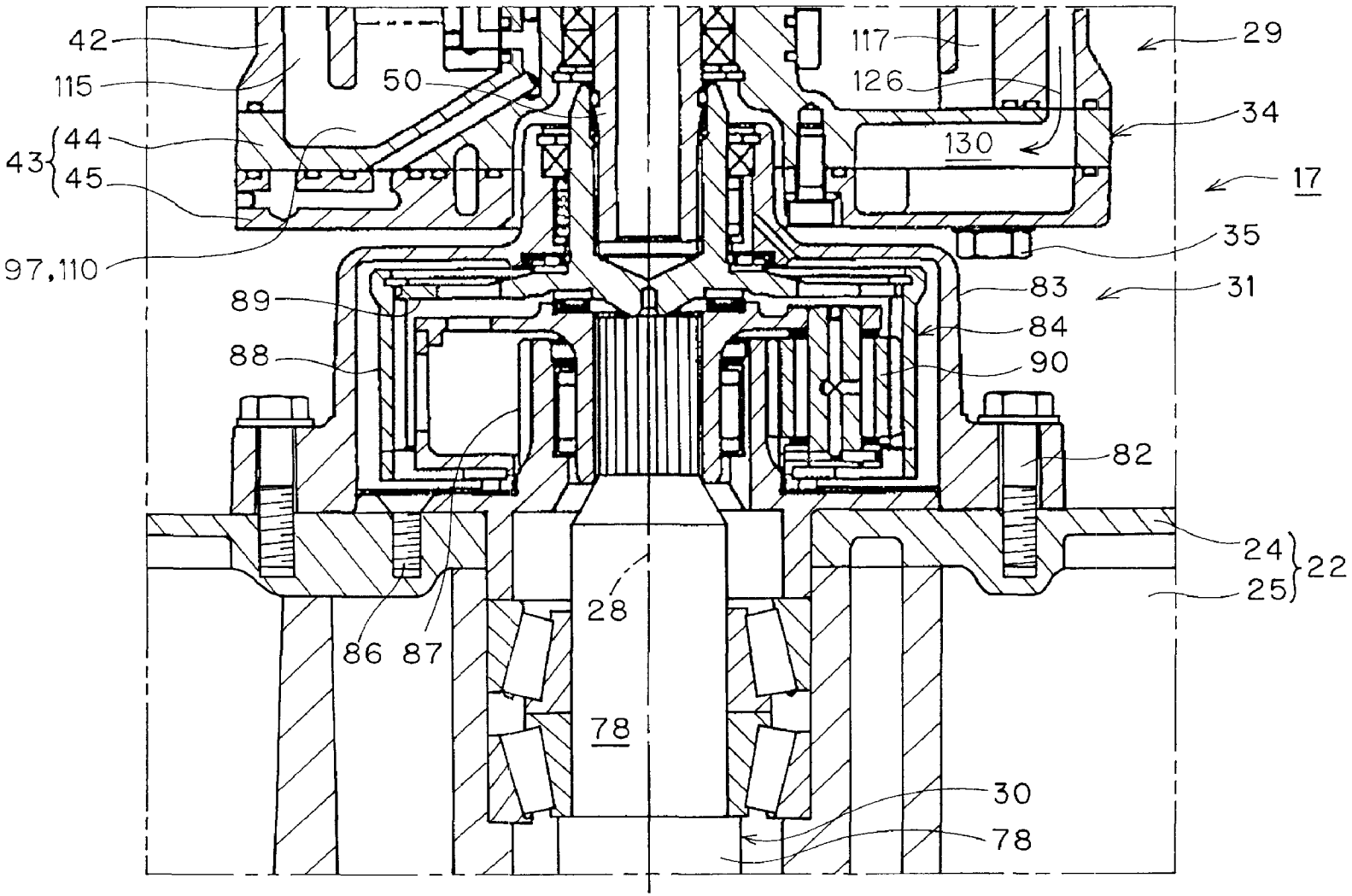
FIG. 6 is an enlarged cross-sectional view of another portion of FIG. 4 of the first preferred embodiment of the present invention.
Figure 7:
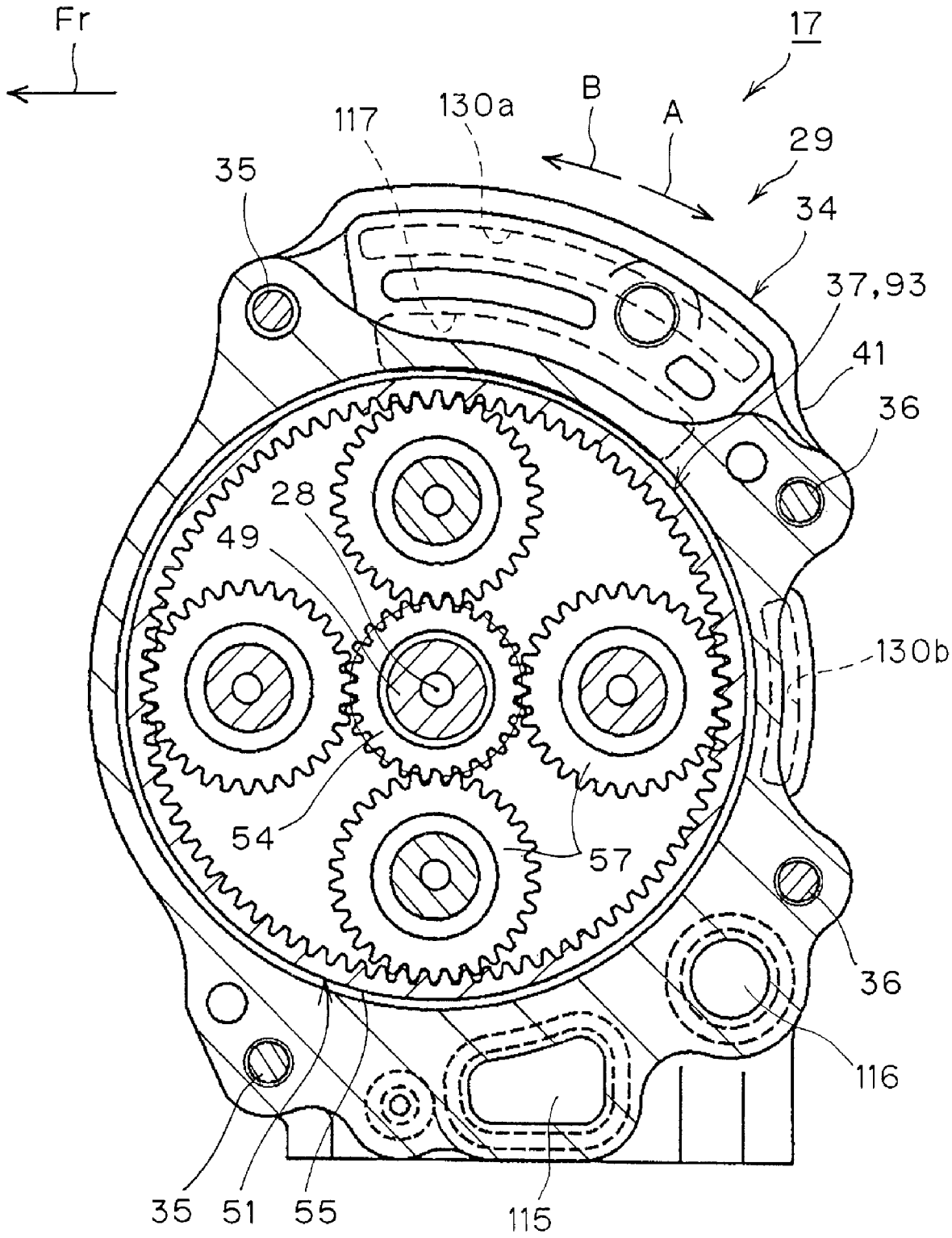
FIG. 7 is a cross-sectional view taken along the line VII-VII in FIG. 4 of the first preferred embodiment of the present invention.
Figure 8:
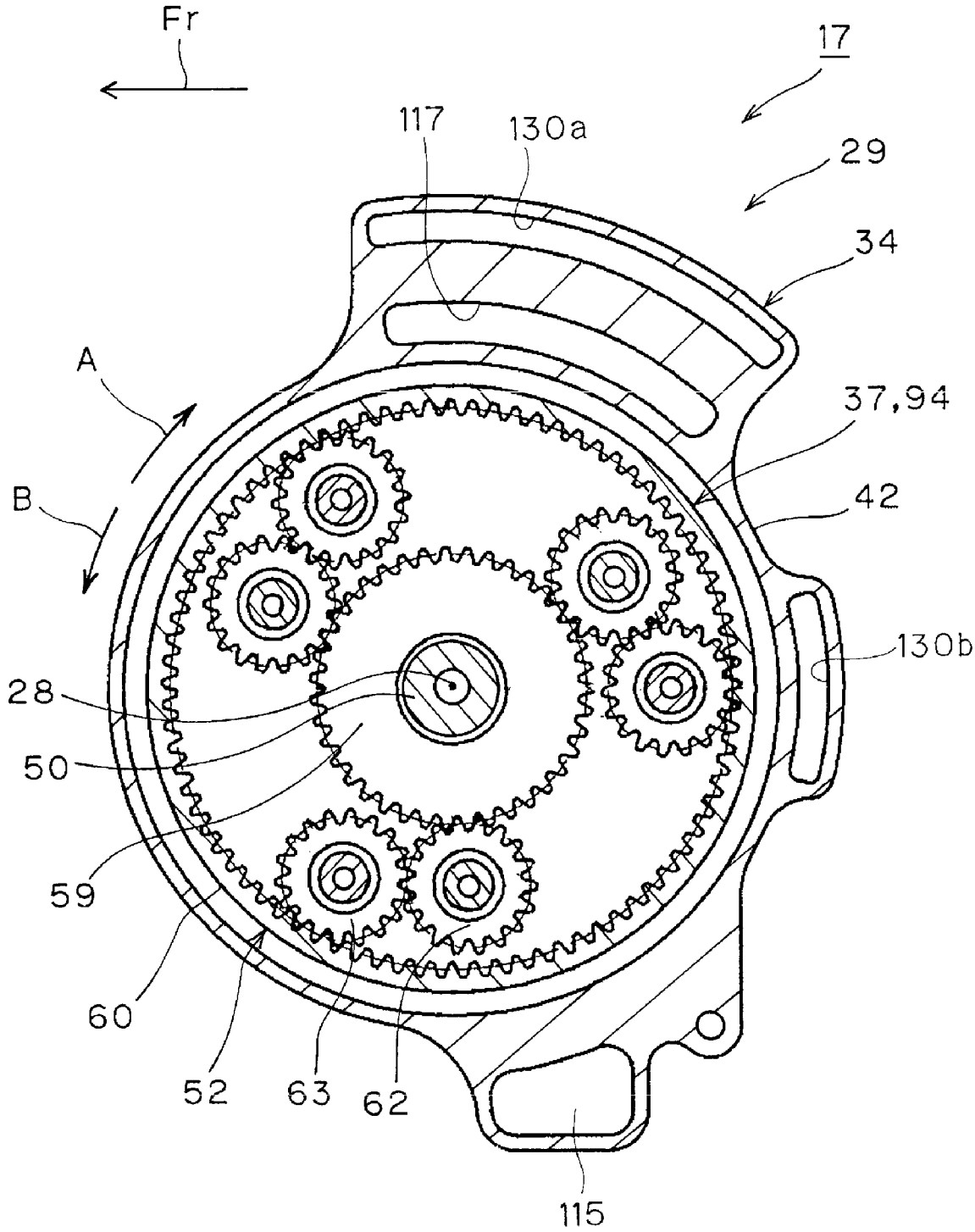
FIG. 8 is a cross-sectional view taken along the line VIII-VIII in FIG. 4 of the first preferred embodiment of the present invention.

In FIGS. 1 to 12, the case 11 includes an upper case 21 that defines the upper side of the case 11, a lower case 22 that is formed separately from the upper case 21 and defines the lower side of the case 11, and a fastener 23 for detachably fixing the lower case 22 to the upper case 21. As seen in FIG. 6, the lower case 22 includes an upper surface board 24 that defines the upper surface thereof and a lower case body 25 that is formed separately from the upper surface board 24, defines the lower side below the upper surface board 24 and is detachably fixed to the upper surface board 24 by a fastener (not shown).

The power transmission system 17 preferably includes a transmission unit 29 that is housed in another (front) space in the case 11 with its axis 28 extending vertically, receives an output from the engine 15, changes a speed of the output, and transmits the output to the propellers 14, an interlocking device 30 that receives an output from the transmission unit 29 and changes its direction to transmit it to the propeller 14, and a speed change device 31 that is interposed between the transmission unit 29 and the interlocking device 30, receives an output from the transmission unit 29, and reduces it with a large reduction ratio to transmit it to the interlocking device 30.

The transmission unit 29 preferably includes a cylindrical transmission case 34 that defines an outer shell of the transmission unit 29 and is disposed on the axis 28, a pair of left and right front bolts 35 that extend vertically in parallel or substantially parallel with the axis 28 and are used to fasten a front portion of the transmission case 34 to the case 11, a pair of left and right rear bolts 36 that extend vertically in parallel or substantially parallel with the axis 28 and are used to fasten a rear portion of the transmission case 34 to the case 11, and a transmission device 37 that is housed in the transmission case 34, receives an output from the engine 15, and changes its speed to transmit it to the propeller 14 via the speed change device 31 and the interlocking device 30 in this order.

The transmission case 34 includes first, second and third cases 40, 41 and 42, respectively, that are separately formed and sequentially arranged from the upper end to the lower end of the transmission case 34. The transmission case 34 also includes a substantially flat case bottom 43 that closes an opening at the lower end of the third case 42. In addition, the case bottom 43 includes an upper and a lower bottom plates 44, 45 that are separately formed and stacked on each other. Each member 40 to 45 of the transmission case 34 is integrally secured to each other preferably by the front bolts 35 and the rear bolts 36, for example.

The transmission device 37 is provided with first, second and third power transmission shafts 48, 49 and 50, respectively, that are sequentially arranged from top to bottom on the axis 28. These shafts 48 to 50 are supported by the transmission case 34 so as to individually rotate about the axis 28. The second power transmission shaft 49 includes a plurality of rotating shafts, for example, two, that are located on the axis 28 and are formed separately. However, the rotating shafts are spline-fitted to each other and rotate integrally.

The transmission device 37 includes an upper planetary gear train 51 and a lower planetary gear train 52. Of these gear trains, the upper planetary gear train 51 includes a sun gear 54 that is rotatable about the axis 28, a ring gear 55 that rotates together with the first power transmission shaft 48, and a planetary gear 57 that is pivotally supported by a carrier 56 to rotate together with the second power transmission shaft 49 and meshes with the sun gear 54 and the ring gear 55. In contrast, the lower planetary gear train 52 includes a sun gear 59 rotating together with the third power transmission shaft 50, a ring gear 60 that is rotatable about the axis 28, a planetary gear 62 that is supported by a carrier 61 rotating together with the second power transmission shaft 49 and meshes with the sun gear 59, and another planetary gear 63 that is pivotally supported by the carrier 61 and meshes with the ring gear 60 and the planetary gear 62.

In addition, the transmission device 37 includes first, second and third clutches 66, 67 and 68, respectively, that preferably are wet-type multi-plate clutches. These clutches 66 to 68 are mounted on the axis 28. Each of the clutches 66 to 68 is usually in a disengaged state due to the action of a spring, however, it is caused to be in an engaged state by a pressing action of first, second and third hydraulic pistons 70, 71 and 72, respectively, on clutch plates 73. A plurality of clutch plates 73 are provided in an axial direction and are annular-shaped.

When the first clutch 66 is engaged, the sun gear 54, the ring gear 55, and the carrier 56 of the upper planetary gear train 51 rotate integrally about the axis 28. A one-way clutch 75 is provided between the sun gear 54 and the transmission case 34 so as to permit the forward rotation A of the sun gear 54 of the upper planetary gear train 51 and prevent the reverse rotation B thereof. Also, when the second clutch 67 is engaged, the ring gear 60 of the lower planetary train 52 is secured to the transmission case 34. In addition, when the third clutch 68 is engaged, the carrier 61 of the lower planetary train 52 and the third power transmission shaft 50 rotate integrally about the axis 28.

In FIGS. 1 to 3 and 6, the interlocking device 30 includes a fourth power transmission shaft 78 supported by the lower case 22 to rotate about the axis 28 and a pair of bevel gear sets 79 for cooperatively coupling each front end of the both propeller shafts 13 to the lower end of the fourth power transmission shaft 78. When power transmission is made from the fourth power transmission shaft 78 to each propeller shaft 13 via each bevel gear set 79 with a change of direction, each propeller shaft 13 is decelerated to rotate together with each propeller 14 in opposite directions.

Figure 4:
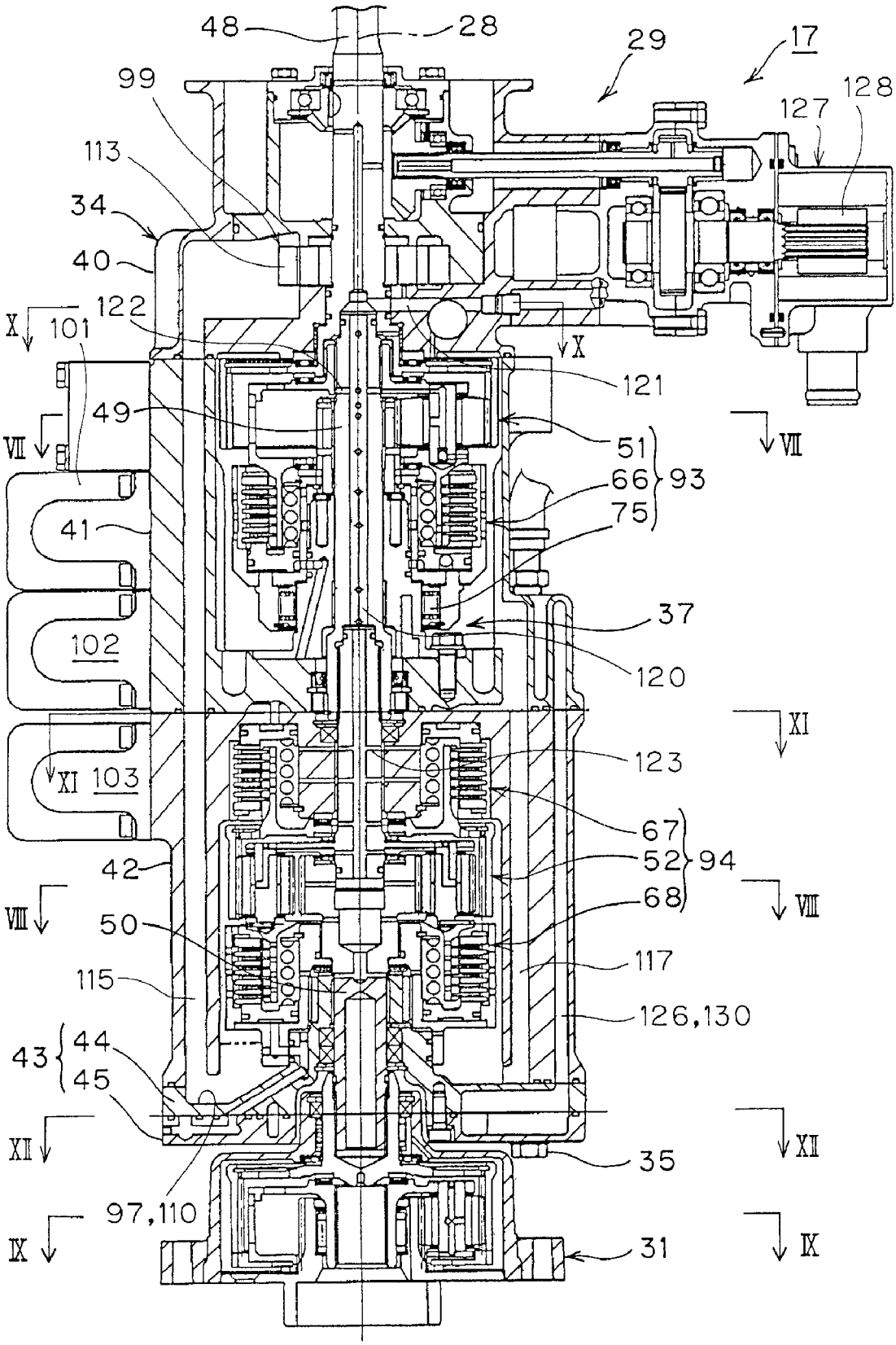
FIG. 4 is an enlarged rear sectional view of the transmission unit of the first preferred embodiment of the present invention.
Figure 5:
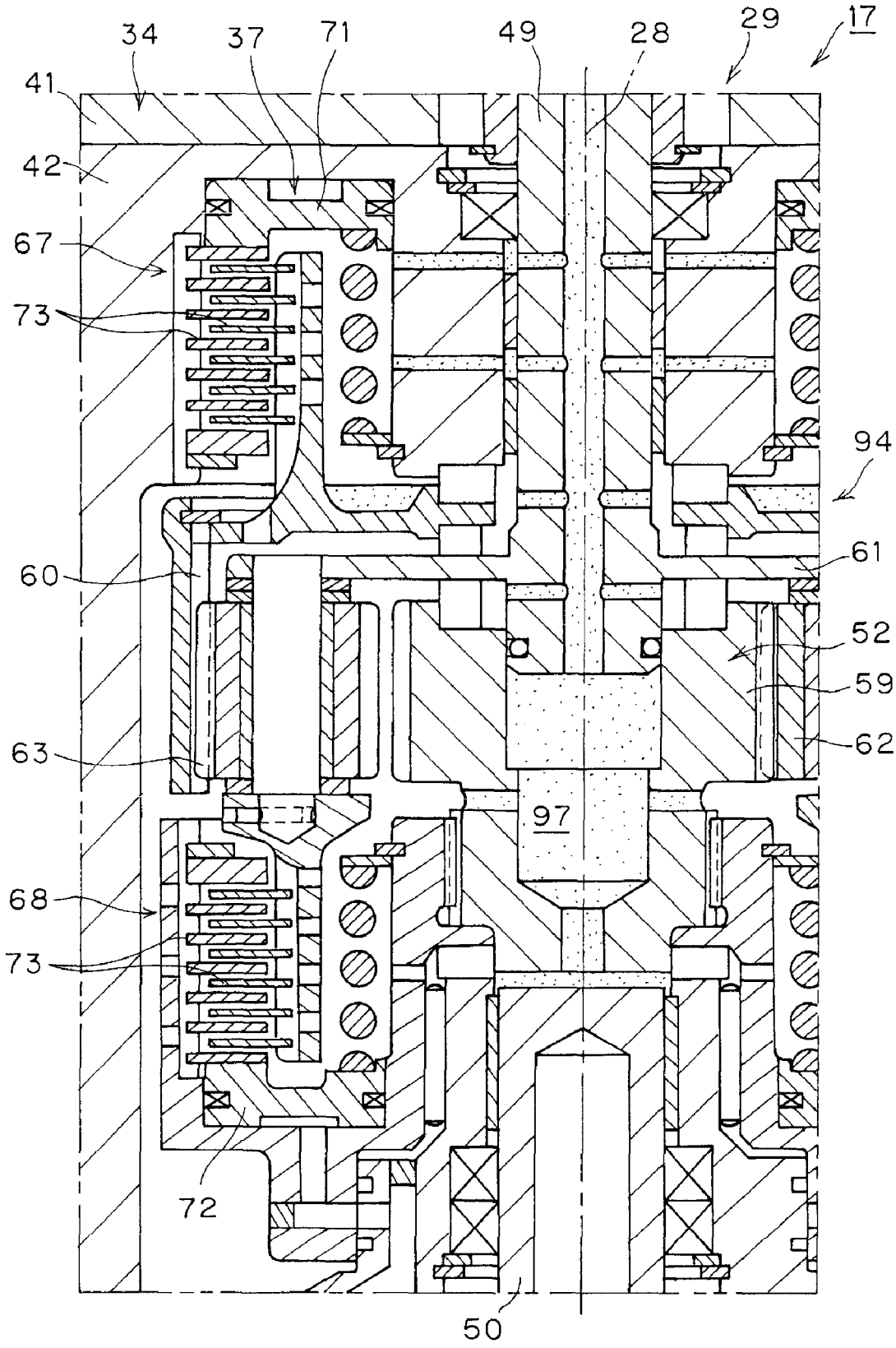
FIG. 5 is an enlarged cross-sectional view of a portion of FIG. 4 of the first preferred embodiment of the present invention.
Figure 9:
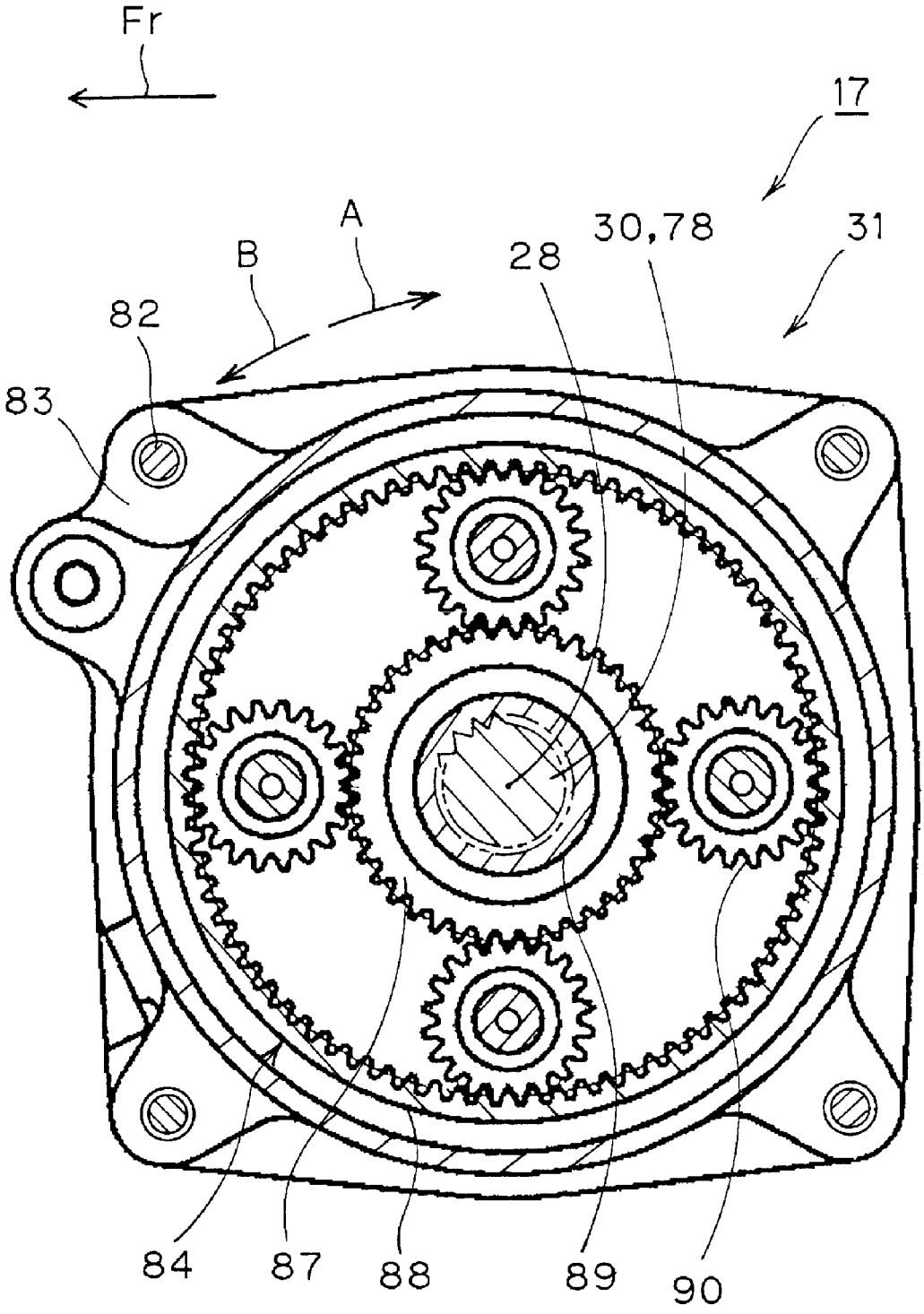
FIG. 9 is a cross-sectional view taken along the line IX-IX in FIG. 4 of the first preferred embodiment of the present invention.
Figure 10:
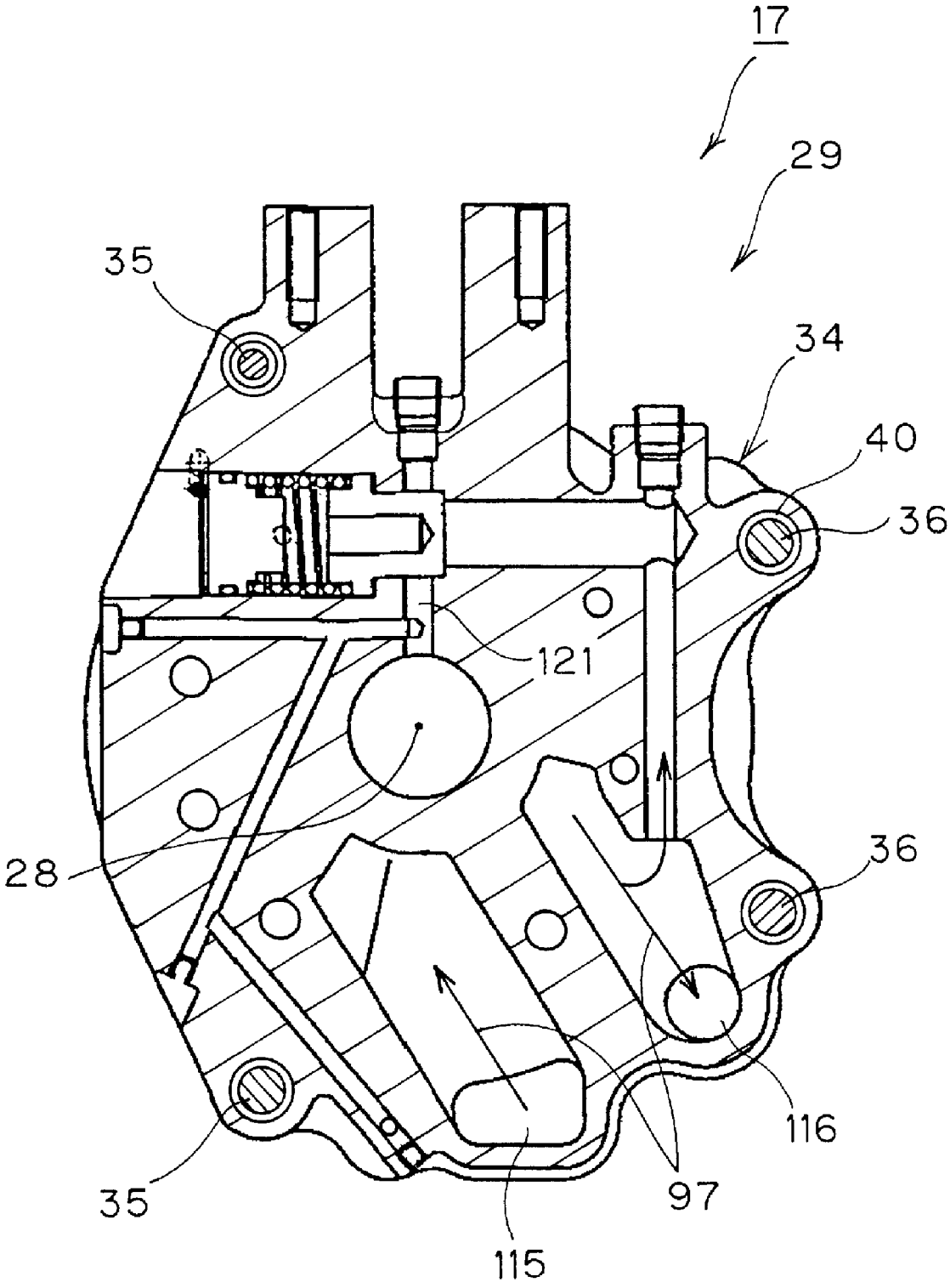
FIG. 10 is a cross-sectional view taken along the line X-X in FIG. 4 of the first preferred embodiment of the present invention.

In FIGS. 4, 6, 9, the speed change device 31 is disposed within a proximal portion between the opposed surfaces of the upper case 21 and the lower case 22 of the case 11 in the vertical direction. More specifically, the speed change device 31 is disposed within the lower end portion of the upper case 21 and supported on the upper surface of the lower case 22. However, the speed change device 31 may be provided in the inner portion of the case 11 that is at the same height as the opposed surfaces of the upper case 21 and the lower case 22, or may be disposed within the upper end portion of the lower case 22.

The speed change device 31 includes a reduction gear case 83 and a planetary gear train 84. The reduction gear case 83 defines an outer shell of the speed change device 31, and is detachably secured to the upper surface board 24 of the lower case 22 by fasteners 82. The planetary gear train 84 is housed in the reduction gear case 83, receives the output from the third power transmission shaft 50 of the transmission device 37, and reduces the speed of the output with a large reduction ratio before transmitting the output to the fourth power transmission shaft 78 of the interlocking device 30.

The planetary gear train 84 includes a sun gear 87 secured to the upper surface board 24 of the lower case 22 by a fastener 86 and integrally provided with the lower case 22, a ring gear 88 supported by the reduction gear case 83 for rotation about the axis 28 and detachably spline-fitted to the lower end of the third power transmission shaft 50 of the transmission device 37, and a planetary gear 90 pivotally supported by a carrier 89 that rotates together with the fourth power transmission shaft 78 of the interlocking device 30 and meshing with the sun gear 87 and the ring gear 88. In order to assemble the transmission unit 29 with the speed change device 31, the third power transmission shaft 50 of the transmission unit 29 is spline-fitted to the ring gear 88 of the speed change device 31 at its lower end while the speed change device 31 is secured to the lower case 22. Then, the above assembly can be accomplished.

The upper planetary gear train 51, the first clutch 66, and the one-way clutch 75 in the transmission device 37 of the transmission unit 29 define a speed change section 93 to change the speed of the output from the power transmission system 17 either to low speed or high speed. The lower planetary gear train 52 and the second and the third clutches 67, 68 in the transmission device 37 define a rotational direction switching section 94 to switch the rotational direction of the output of the power transmission system 17 either to the forward rotation A or to the reverse rotation B.

In FIGS. 3 to 12, an oil supply device 99 is provided to supply oil 97 to a supplied section 98 to which the oil 97 should be supplied for the operation and lubrication of the first to the third pistons 70 to 72 of the first to the third clutches 66 to 68 of the boat propulsion unit 4.

The oil supply device 99 is provided with a first, second and third hydraulically-controlled valves 101, 102 and 103, respectively, that are preferably solenoid operated valves and respectively correspond to the first, second and third clutches 66, 67 and 68. These valves 101 to 103 are attached to an outer surface of one side (left side) portion of the transmission case 34. First, second and third pressured oil passages 105, 106 and 107, respectively, are formed in the transmission case 34 such that they respectively extend from the first to the third hydraulically-controlled valves 101 to 103 to each hydraulic chamber that corresponds to the first to the third pistons 70 to 72. The pressurized oil 97 is supplied to each of the hydraulic chambers through each of the hydraulically-controlled valves 101 to 103. Consequently, the pressing operation of the first to the third pistons 70 to 72 against the clutch plates 73 is made possible.

The oil supply device 99 preferably includes an oil pan 110 formed in a bottom portion of the transmission case 34, a pipe-shaped inlet port 111 with an entry section disposed in a front portion of the oil pan 110 and with an exit section extending obliquely upward to one side (left side) portion of the transmission case 34, a wire-woven oil filter 112 attached to the entry section of the inlet port 111, and an oil pump 113 that is provided in the first case 40 of the transmission case 34 and is driven by the engine 15 via the first transmission shaft 48. In a state where the case bottom 43 is detached from the third case 42 of the transmission case 34, a lower end opening of the third case 42 opens downward. Then, the inlet port 111 is detachably secured to a lower surface of the third case 42 with a fastener via the lower end opening.

The oil supply device 99 also preferably includes an oil inlet passage 115 formed in the transmission case 34 so that the exit section of the inlet port 111 communicates with an inlet section of the oil pump 113, a first oil supply passage 116 formed in the transmission case 34 so that a discharge section of the oil pump 113 communicates with the first, second and third hydraulically-controlled valves 101, 102 and 103, respectively, which are the supplied section 98, and an oil return passage 117 arranged to return the discharged oil 97 to the oil pan 110 after the oil 97 is supplied to the hydraulic chambers corresponding to the first, second and third pistons 70, 71 and 72.

Of a left side portion and a right side portion of the transmission case 34, the oil inlet passage 115 and the first oil supply passage 116 are formed in one side (left side) portion. Meanwhile, the oil return passage 117 is formed in the other side (right side) portion of the transmission case 34. In this case, the lower portion of the transmission case 34 entirely covers the lower planetary gear train 52 from the outside in its radial direction, and the oil return passage 117 is formed in the other side (right side) portion in the lower portion of the transmission case 34.

The oil supply device 99 preferably further includes a second oil supply passage 120 formed on the axis 28 of the first and the second power transmission shafts 48, 49, a third oil supply passage 121 formed in the transmission case 34 so that the discharge section of the oil pump 113 communicates with the second oil supply passage 120, a fourth oil supply passage 122 formed across the second power transmission shaft 49 so that an upper section of the second oil supply passage 120 communicates with the upper planetary gear train 51 and the first clutch 66 that are the supplied section 98, and a fifth oil supply passage 123 formed across the second power transmission shaft 49 and in the transmission case 34 so that the lower section of the second oil supply passage 120 communicates with the lower planetary gear train 52 and the second and the third clutches 67, 68 that are the supplied section 98.

The operation of the oil supply device 99 to supply the oil 97 to the supplied section 98 will be described.

When the oil pump 113 is activated in conjunction with the engine 15, the oil 97 in the oil pan 110 sequentially passes through the oil filter 112 and the inlet port 111 to be sucked into the oil pump 113.

Then, one portion of the oil 97 that is pressurized by the oil pump 113 and discharged therefrom is supplied to the engine 15 for lubrication. Another portion of the discharged oil 97 is supplied to the first, second and third hydraulically-controlled valves 101, 102 and 103, respectively, through the first oil supply passage 116. With the control of a transmission control device (not shown) by a crewmember, each of the hydraulically-controlled valves 101 to 103 is operated, and the oil 97 is supplied to the hydraulic chambers corresponding to the first, second and third pistons 70, 71 and 72, respectively. Then, the given operation is carried out. After this operation, the oil 97 discharged from each of the hydraulic chambers is returned to the oil pan 110 either directly or through the oil return passage 117.

Further, the other portion of the oil 97 that is discharged from the oil pump 113 passes through the third oil supply passage 121, the second oil supply passage 120, and the fourth oil supply passage 122 and then lubricates the upper planetary gear train 51 and the first clutch 66. The oil 97 after lubrication is returned to the oil pan 110 through the oil return passage 117 while detouring around the lower planetary gear train 52. Still another portion of the oil 97 passes from the second oil supply passage 120 through the fifth oil supply passage 123 and then lubricates the lower planetary gear train 52, the second and the third clutches 67, 68. The oil 97 after the above-described lubrication does not pass through the oil return passage 117 but is directly returned to the oil pan 110.

As shown in FIGS. 3, 4, 6 to 8, 10 to 12, a water cooling apparatus 127 for cooling each component with cooling water 126 is provided in the boat propulsion unit 4.

The water cooling apparatus 127 is supported on an outer surface in the other side portion (right side portion) of the first case 40 of the transmission case 34. The water cooling apparatus 127 preferably includes a water pump 128 that is cooperatively coupled with the engine 15 through the first power transmission shaft 48, a water intake passage 129 formed in the transmission case 34 such that the front portion of the lower case 22, into which the water 2 can flow, communicates with an intake section of the water pump 128, and a cooling water passage 130 formed in the transmission case 34 to extend from a discharge section of the water pump 128 to the bottom portion of the transmission case 34.

In the plan sectional view of the transmission unit 29 at the middle thereof in the axial direction (especially in FIG. 11), a cooling water passage 130*a*, which is one portion of the cooling water passage 130, is formed in the other side (right side) portion of the transmission case 34, and a cooling water passage 130*b*, which is another portion of the cooling water passage 130, is formed in the rear portion of the transmission case 34. As seen in the plan sectional view of the transmission unit 29 at the case bottom 43 (FIG. 12), a lower end portion of the water cooling passage 130 preferably has a substantially annular shape arranged to extend around the axis 28 and widely cover the case bottom 43. One end of the cooling water passage 130 having the substantially annular shape communicates with an area below the transmission case 34 through a drain hole 131 formed in the bottom portion of the transmission case 34.

When the water pump 128 is activated in conjunction with the engine 15, the water 2 is sucked into the water pump 128 through the front portion of the lower case 22 and the water intake passage 129. Then, the water 2 sucked in the water pump 128 is supplied to the cooling water passage 130 so as to cool the transmission unit 29. After cooling the transmission unit 29, the water 2 passes through the drain hole 131 at the lower end of the cooling water passage 130 in the transmission unit 29 and is discharged to the outside below the drain hole 131.

Figure 3:
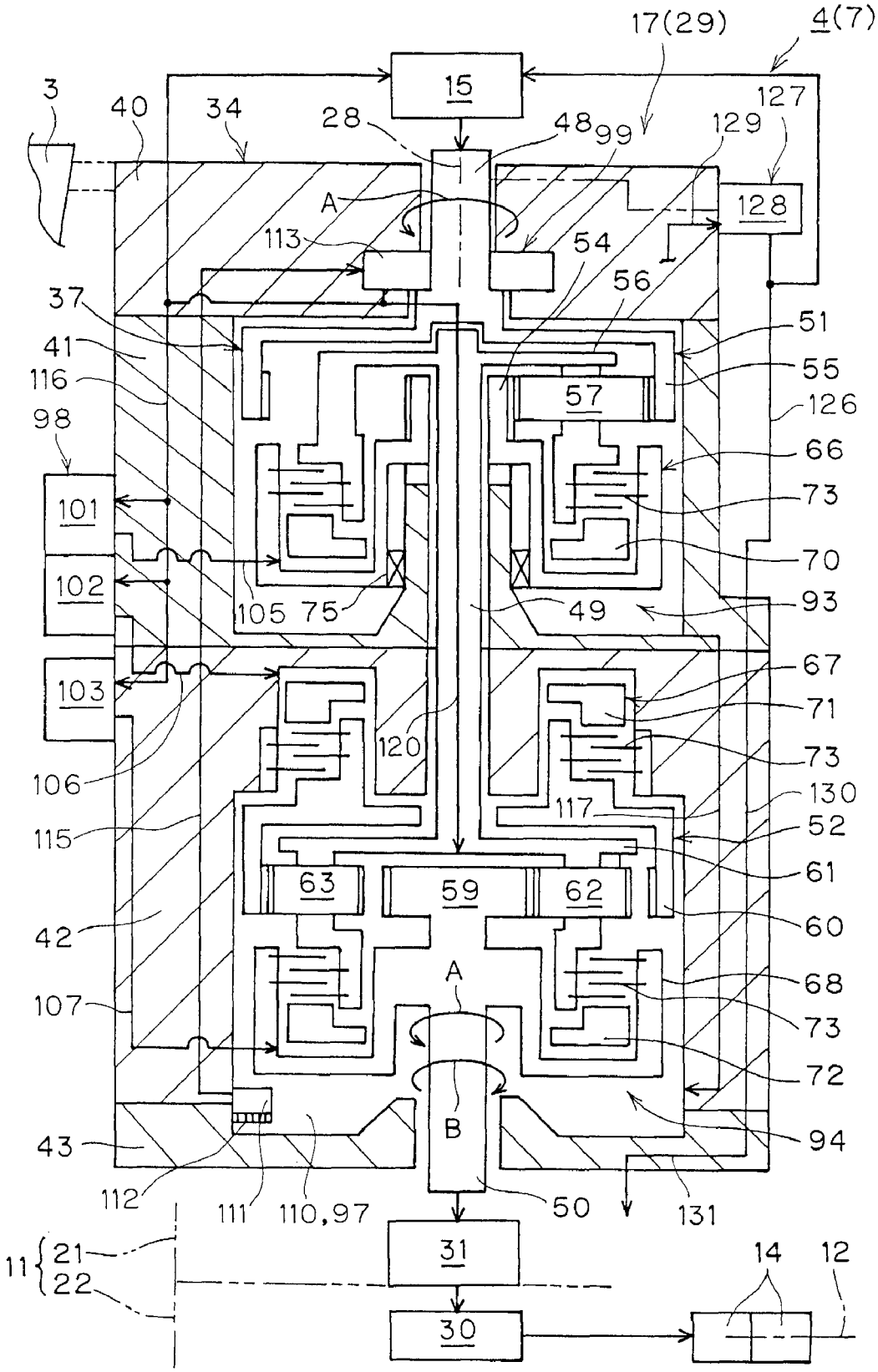
FIG. 3 is a schematic diagram of the boat propulsion unit of the first preferred embodiment of the present invention.

Referring to FIGS. 3 and 13, a speed change operation by the speed change section 93 and the rotational direction switching section 94 of the transmission unit 29 of the power transmission system 17 will now be described.

First, the first clutch 66 and the second clutch 67 are adapted to be in the disengaged state, and the third clutch 68 is adapted to be in the engaged state. This brings the power transmission device 17 to a speed change state of "slow forward travel."

That is, during the disengaged state of the first clutch 66, if the ring gear 55 of the upper planetary gear train 51 operates in the forward rotation A together with the first power transmission shaft 48 by the output from the engine 15, the sun gear 54 attempts to operate in the reverse rotation B via the planetary gear 57. However, the reverse rotation B of the sun gear 54 is prevented by the one-way clutch 75. Therefore, the forward rotation A of the ring gear 55 is decelerated via the planetary gear 57 and the carrier 56, and then is transmitted to the second power transmission shaft 49. Consequently, the second power transmission shaft 49 operates in the forward rotation A at a low speed.

Then, the carrier 61 of the lower planetary gear train 52 operates in the forward rotation A at the low speed along with the second power transmission shaft 49. In addition, the third power transmission shaft 50 that is unified with the carrier 61 due to the engaged state of the third clutch 68, which is described above, operates in the forward rotation A at the low speed. This brings the power transmission system 17 to the speed change state of "slow forward travel." Then, the forward rotation A of the third power transmission shaft 50 is transmitted to each of the propellers 14 via the speed change device 31, the interlocking device 30, and each of the propeller shafts 13 in sequence to permit "slow forward travel" of the boat 1.

Secondly, the first clutch 66 and the third clutch 68 are adapted to be in the engaged state while the second clutch 67 is adapted to be in the disengaged state. This brings the power transmission device 17 to the speed change state of "fast forward travel."

More specifically, as described above, when the first clutch 66 is engaged, the components 54 to 57 of the upper planetary gear train 51 operate integrally in the forward rotation A. This brings the second power transmission shaft 49 to be directly connected to the engine 15 via the first power transmission shaft 48. Thus, the second power transmission shaft 49 operates in the forward rotation A at the high speed.

Consequently, the carrier 61 of the lower planetary gear train 52 operates in the forward rotation A at the high speed along with the second power transmission shaft 49. In addition, the third power transmission shaft 50 unified with the carrier 61 due to the engaged state of the third clutch 68, which is described above, operates in the forward rotation A at the high speed. This brings the power transmission system 17 to the speed change state of "fast forward travel." Then, the forward rotation A of the third power transmission shaft 50 is transmitted to each of the propellers 14 via the speed change device 31, the interlocking device 30, and each of the propeller shafts 13 in sequence to permit "fast forward travel" of the boat 1.

Thirdly, the first clutch 66, the second clutch 67, and the third clutch 68 are all adapted to be in the disengaged state. This brings the lower planetary gear train 52 to an idling state although the upper planetary gear train 51 operates in the forward rotation A at the low speed. Consequently, the power transmission system 17 goes into the speed change state of "neutral," and the propellers 14 rotate freely. It should be noted however that the above "neutral" state can be attained even though the first clutch 66 is engaged as far as the second clutch 67 and the third clutch 68 are disengaged.

Fourthly, the first clutch 66 and the third clutch 68 are adapted to be in the disengaged state, and the second clutch 67 is adapted to be in the engaged state. This brings the power transmission device 17 into the speed change state of "slow reverse travel."

In other words, due to the disengaged state of the first clutch 66, the second power transmission shaft 49 operates in the forward rotation A at the low speed as in the speed change state of the "slow forward travel."

Then, the carrier 61 of the lower planetary gear train 52 operates in the forward rotation A at the low speed along with the second power transmission shaft 49. At this time, the ring gear 60 of the lower planetary gear train 52 is secured to the transmission case 34 due to the engaged state of the second clutch 67. In contrast, due to the disengaged state of the third clutch 68, the forward rotation A of the carrier 61 is reversed through the planetary gear 63 and the planetary gear 62 in sequence, and causes the third power transmission shaft 50 to operate in the reverse rotation B at the low speed. This brings the power transmission system 17 to the speed change state of "slow reverse travel." Then, the reverse rotation B of the third power transmission shaft 50 is transmitted to each of the propellers 14 via the speed change device 31, the interlocking device 30, and each of the propeller shafts 13 in sequence to permit "slow reverse travel" of the boat 1.

Fifthly, the first clutch 66 and the second clutch 67 are adapted to be in the engaged state while the third clutch 68 is adapted to be in the disengaged state. This brings the power transmission device 17 to the speed change state of "fast reverse travel."

In other words, due to the engaged state of the first clutch 66, the second power transmission shaft 49 operates in the forward rotation A at the high speed as in the speed change state of the "fast forward travel."

Consequently, the carrier 61 of the lower planetary gear train 52 operates in the forward rotation A at the high speed along with the second power transmission shaft 49. At this time, due to the engaged state of the second clutch 67, the ring gear 60 of the lower planetary gear train 52 is secured to the transmission case 34. In contrast, due to the disengaged state of the third clutch 68, the forward rotation A of the carrier 61 is reversed via the planetary gear 63 and the planetary gear 62 in sequence, and causes the third power transmission shaft 50 to operate in the reverse rotation B at the high speed. This brings the power transmission system 17 to the speed change state of "fast reverse travel." Then, the forward rotation A of the third power transmission shaft 50 is transmitted to each of the propellers 14 via the speed change device 31, the interlocking device 30, and each of the propeller shafts 13 in sequence to permit "fast reverse travel" of the boat 1.

In FIGS. 3, 4, 6 to 8, 11, 12, in the plan sectional view of the transmission unit 29 at the middle in the axial direction (especially in FIG. 11), the cooling water passage 130*a*, which is one portion of the cooling water passage 130, is formed in the other side (right side) portion of the transmission case 34, and the cooling water passage 130*b*, which is the other portion of the cooling water passage 130, is formed in the rear portion of the transmission case 34. In this case, the cooling water passage 130 may be formed in the side (left side) portion of the transmission case 34, or may be formed only in either one of each side portion or the rear portion of the transmission case 34. A total cross-sectional area S1 of the cooling water passage 130 in front of the axis 28 of the transmission case 34 is preferably smaller than a total cross-sectional area S2 of the cooling water passage 130 behind the axis 28 (S1<S2).

Figure 11:
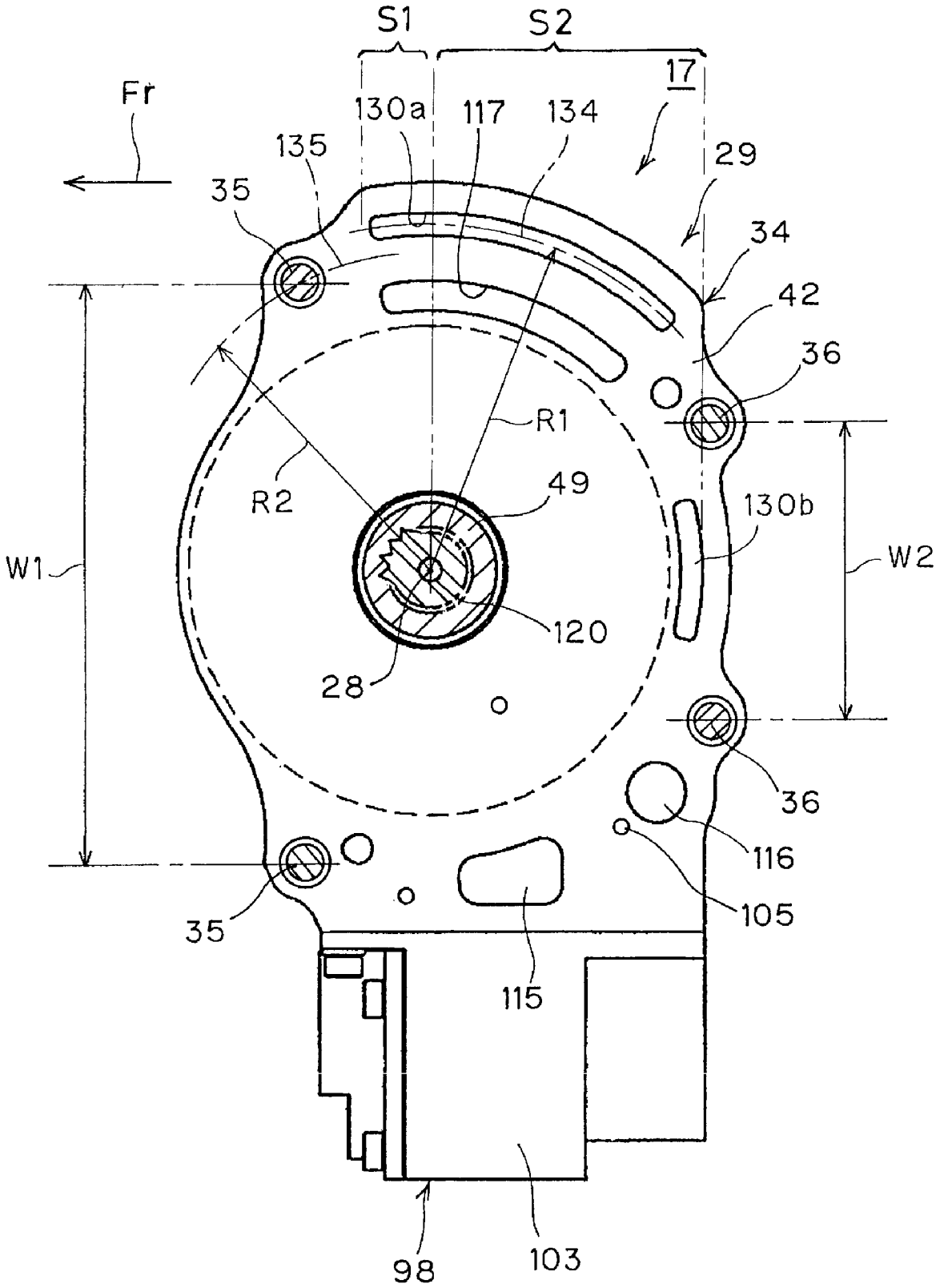
FIG. 11 is a cross-sectional view taken along the line XI-XI in FIG. 4 of the first preferred embodiment of the present invention.
Figure 12:
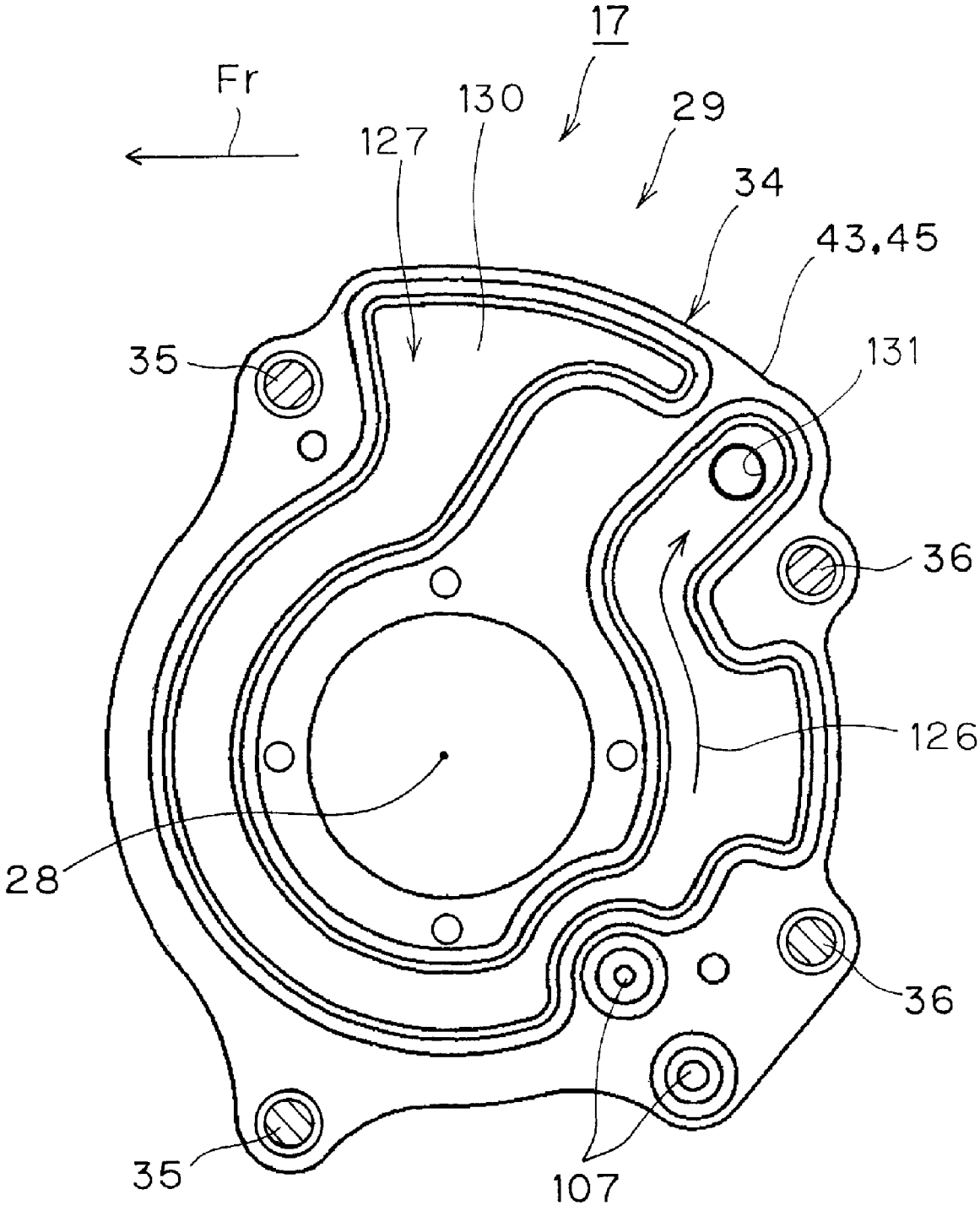
FIG. 12 is a cross-sectional view taken along the line XII-XII in FIG. 4 of the first preferred embodiment of the present invention.

Especially in FIG. 11, S1 indicates across-sectional area of the cooling water passage 130*a* in front of the axis 28 of the transmission case 34 while S2 indicates a total of a cross-sectional area of the cooling water passage 130*a* behind the axis 28 of the transmission case 34 and a cross-sectional area of the cooling water passage 130*b* formed in the rear portion of the transmission case 34. If the cooling water passage 130 is formed only in each side portion of the transmission case, the cross-sectional area S1 of the cooling water passage in front of the axis 28 of the transmission case 34 is preferably smaller than the cross-sectional area S2 behind the axis 28 of the transmission case 34. If the cooling water passage 130 is formed only in the rear portion of the transmission case, the cross-sectional area S1 of the cooling water passage in front of the axis 28 of the transmission case 34 becomes zero, so that S1 is preferably smaller than the cross-sectional area S2 of the cooling water passage formed in the rear portion of the transmission case 34.

Therefore, in the plan sectional view of the transmission unit 29, it is possible to prevent the forward expansion of the front outer surface of the transmission case 34 due to forming the cooling water passage 130 in the transmission case 34 of the transmission unit 29. In addition, the above described prevention of the forward expansion of the front outer surface of the transmission case 34 also makes it possible to prevent the forward expansion of the front outer surface of the case 11 housing the transmission unit 29.

Accordingly, the center of gravity of the boat propulsion unit 4 can be set closer to the rear portion of the hull 3 while avoiding contact of the rear portion of the hull 3 with the front outer surface of the case 11. As a result, it is possible to reduce the magnitude of the support moment generated when the rear portion of the hull 3 supports the boat propulsion unit 4. Therefore, it is possible to relieve strain on the rear portion of the hull 3.

Also, as described above, a total cross-sectional area S1 of the cooling water passage 130 in front of the axis 28 of the transmission case 34 is preferably smaller than a total cross-sectional area S2 of the cooling water passage 130 behind the axis 28.

That is, if the total cross-sectional area of the cooling water passage 130 behind the axis 28 is increased while minimizing the total cross-sectional area of the cooling water passage 130 in front of the axis 28, the amount of the cooling water 126 flowing through the cooling water passage 130 can be increased, thereby sufficiently cooling the transmission unit 29 and preventing the forward expansion of the front outer surface of the transmission case 34. Therefore, for the same reasons as described above, it is possible to relieve strain on the rear portion of the hull 3 that supports the boat propulsion unit 4.

Further, the transmission unit 29 preferably includes a pair of the left and the right front bolts 35, for example, extending vertically to fasten the front portion of the transmission case 34 to the case 11 and a pair of the left and the right rear bolts 36 extending vertically to fasten the rear portion of the transmission case 34 to the case 11. The width dimension W1 between the left and the right front bolts 35 is preferably larger than the width dimension W2 between the left and the right rear bolts 36, 36 in the width direction of the hull 3.

Due to the above configuration, the left and the right front bolts 35 can be respectively positioned in the right side portion and the left side portion of the transmission case 34. Consequently, it is possible to prevent the forward expansion of the front outer surface of the transmission case 34 due to the disposition of each of the front bolts 35. In addition, the above advantageous effect also makes it possible to prevent the forward expansion of the front outer surface of the case 11 housing the transmission unit 29. Therefore, for the same reason as above, it is possible to reduce the strain on the rear portion of the hull 3.

As described above, in the plan sectional view of the transmission unit 29 (especially in FIG. 11), the cooling water passage 130 is formed on a first arc 134 having a first radius R1 centered at the axis 28. The axes of the front bolts 35 are located on a second arc 135 having a second radius R2 centered at the axis 28. The second radius R2 is preferably smaller than the first radius R1. In other words, the cooling water passage 130 is disposed at a position that is located farther outward to the rear than the front bolt 35.

With this unique structure, since the cooling water passage 130 can be formed on the first arc 134 having the first large radius R1 while avoiding interference with each of the front bolts 35, the cross-sectional area of the cooling water passage 130 can further be enlarged without the forward expansion of the front outer surface of the transmission case 34. Therefore, it is possible to increase the amount of the cooling water 126 that flows through the cooling water passage 130, thereby sufficiently cooling the transmission unit 29.

As described above, the oil return passage 117 preferably is formed in the side portion of the transmission case 34 such that the oil 97, which has lubricated the transmission device 37 of the transmission unit 29, flows down to the oil pan 110. The cooling water passage 130*a* formed in the side portion of the transmission case 34 is located outside the oil return passage 117.

Due to the above configuration, the oil 97 in the oil return passage 117 can be cooled more directly and efficiently with the cooling water 126 flowing through the cooling water passage 130*a*. Therefore, degradation of the oil 97 can be reliably prevented.

Also, as described above, the oil pan 110 and the lower end portion of the water cooling passage 130 are formed in the case bottom 43 defining the bottom of the transmission case 34.

With this unique structure, the oil 97 collected in the oil pan 110 can be cooled more directly and efficiently with the cooling water 126 flowing through the lower end portion of the cooling water passage 130. Therefore, degradation of the oil 97 can be reliably prevented.

As described above, the cooling water passage 130*a* formed in the side portion of the transmission case 34 is located on the outer side of the oil return passage 117.

With this unique structure, first, since the cooling water passage 130*a* is located further away from the axis 28 than the oil return passage 117, the length of the cooling water 130*a* around the axis 28 can be further extended. Therefore, due to the extended cooling water passage 130*a*, it is possible to increase the amount of the cooling water 126 that flows through the cooling water passage 130*a*, thereby sufficiently cooling the oil 97 in the oil return passage 117.

Secondly, in the case 11, the exhaust passage 20 is formed right outside the transmission case 34 in a radial direction, and the exhaust gas 19 flows through the exhaust passage 20. Here, as described above, the cooling water passage 130*a* is located on the outside of the oil return passage 117. Therefore, with the cooling water 126 flowing through the cooling water passage 130*a*, it is possible to prevent the oil 97 flowing through the oil return passage 117 from being heated by exhaust heat of the exhaust gas 19.

In the plan sectional view of the transmission unit 29 (especially in FIG. 11), the arc of the cooling water passage 130 around the axis 28 of the transmission case 34 is preferably longer than that of the oil return passage 117.

With this unique structure, the cross-sectional area of the cooling water passage 130 can further be enlarged. Therefore, it is possible to increase the amount of the cooling water 126 that flows through the cooling water passage 130, thereby further sufficiently cooling the oil 97 in the oil return passage 117.

Further, as described above, the lower end portion of the water cooling passage 130 preferably has a substantially annular shape to extend around the axis 28.

With this unique structure, a contact area between the cooling water 126 flowing through the cooling water passage 130 and the bottom 43 can be enlarged. Therefore, the oil 97 collected in the oil pan 110 in the bottom 43 can be further effectively cooled with the cooling water 126.

The above description is based on the illustrated example. However, the engine 15 may be supported on the hull 3. The transmission case 34 may be integrally formed with the case 11. The upper surface board 24 of the lower case 22 and the lower case body 25 may be integrally formed with each other. A multi-plate clutch may be provided instead of the one-way clutch 75. Moreover, the cooling water passages 130*a*, 130*b* may be continuous with each other in the plan sectional view of the transmission unit 29.

Figure 14:
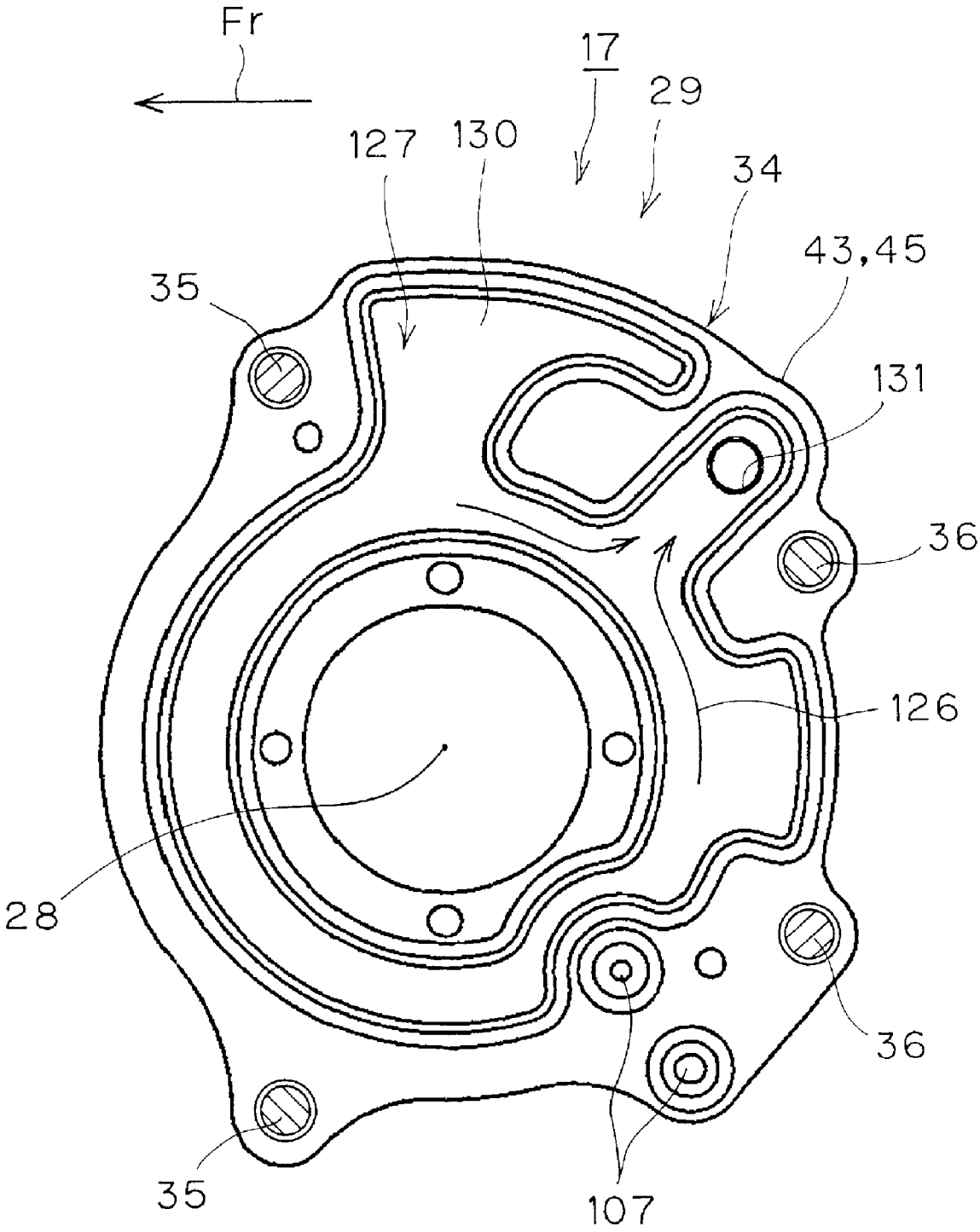
FIG. 14 is a view corresponding to FIG. 12, showing a second preferred embodiment of the present invention.
Figure 15:
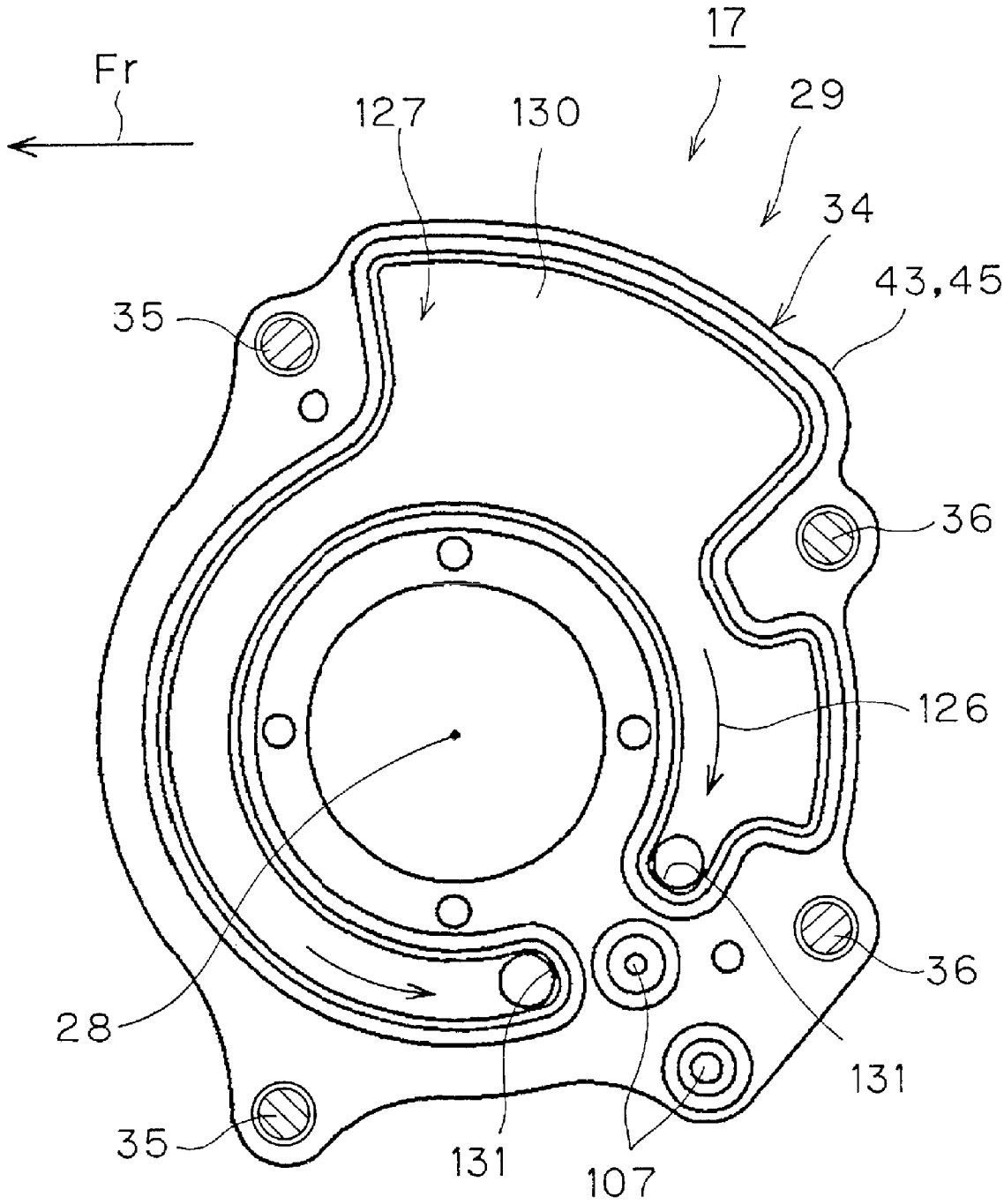
FIG. 15 is a view corresponding to FIG. 12, showing a third preferred embodiment of the present invention.

FIGS. 14 and 15 show second and third preferred embodiments of the present invention. The second and third preferred embodiments have many configurations and effects in common with the first preferred embodiment. Therefore, those elements corresponding to the elements in the first preferred embodiment are identified with the same reference numerals and symbols in the drawings and their description is not repeated, and differences are mainly described below. The structures of the elements and features of the preferred embodiments may be combined in various ways in the light of the advantages and effects of the present invention.

Second Preferred Embodiment

For the purpose of describing the present invention in further detail, the second preferred embodiment of the invention is described with reference to FIG. 14 attached hereto.

In FIG. 14, the lower end portion of the cooling water passage 130 preferably has a substantially annular shape in the plan sectional view of the transmission unit 29 at the case bottom 43. With this unique structure, the cooling water 126 flows more smoothly in the lower end portion of the cooling water passage 130. Therefore, the oil 97 in the oil pan 110 can be further effectively cooled with the cooling water 126.

Third Preferred Embodiment

Description will be hereinafter made of the third preferred embodiment of the present invention in detail with reference to FIG. 15 attached hereto.

In FIG. 15, the lower end portion of the cooling water passage 130 preferably has a substantially C-shape configuration that is substantially annular in the plan sectional view of the transmission unit 29 at the case bottom 43. A plurality, for example two, drain holes 131, each formed at each end of the substantially c-shaped cooling water passage, are formed on the circumference around the axis 28.

With this unique structure, the cooling water respectively flows toward each of the drain holes 131 from the upstream side of the cooling water passage 130 in the lower end portion of the cooling water passage 130. The cooling water 126 can thereby be prevented from flowing unevenly or stagnating in the lower end portion of the cooling water passage 130. Accordingly, the cooling water 126 can flow throughout each portion of the cooling water passage 130. As a result, the oil 97 in the oil pan 110 can be further effectively cooled with the cooling water 126. It should be noted that three or more drain holes 131 may be formed on the circumference around the axis 28.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A water cooling apparatus in a power transmission system of a boat propulsion unit comprising:

a case arranged to be located behind a hull and supported by a rear portion of the hull;

a propeller supported by a lower portion of the case; and a transmission unit housed in the case and arranged to receive a rotational output from an engine, change a speed of the rotational output, and transmit the rotational output to the propeller, the transmission unit including a cylindrical transmission case defining an outer shell of the transmission unit with an axis of the transmission case extending vertically, a transmission device housed in the transmission case and arranged to change the speed of the rotational output of the engine, and a cooling water passage provided in the transmission case for flowing cooling water; wherein the cooling water passage is located in at least one of a side portion or a rear portion of the transmission case in a plan sectional view of the transmission unit.

2. The water cooling apparatus in the power transmission system of the boat propulsion unit according to claim 1, wherein a total cross-sectional area of the cooling water passage in front of the axis of the transmission case is smaller than a total cross-sectional area of the cooling water passage behind the axis.

3. The water cooling apparatus in the power transmission system of the boat propulsion unit according to claim 1, wherein the transmission unit includes a pair of left and right front bolts extending vertically to fasten a front portion of the transmission case to the case and a pair of left and right rear bolts extending vertically to fasten the rear portion of the transmission case to the case, and a width dimension between the left and the right front bolts is larger than a width dimension between the left and the right rear bolts in a width direction of the hull.

4. The water cooling apparatus in the power transmission system of the boat propulsion unit according to claim 3, wherein in the plan sectional view of the transmission unit, the cooling water passage located on a first arc having a first radius centered at the axis of the transmission case, axes of the front bolts are located on a second arc having a second radius centered at the axis of the transmission case, and the second radius is smaller than the first radius.

5. The water cooling apparatus in the power transmission system of the boat propulsion unit according to claim 1, wherein an oil return passage is arranged in the side portion of the transmission case such that oil, which has lubricated the transmission device of the transmission unit, flows down to an oil pan provided in a lower portion of the transmission case, and the cooling water passage provided in the side portion of the transmission case is located outside the oil return passage.

6. The water cooling apparatus in the power transmission system of the boat propulsion unit according to claim 5, wherein the oil pan and a lower end portion of the water cooling passage are located in a case bottom defining a bottom of the transmission case.

7. The water cooling apparatus in the power transmission system of the boat propulsion unit according to claim 6, wherein the arc of the cooling water passage around the axis of the transmission case is longer than that of the oil return passage in the plan sectional view of the transmission unit.

8. The water cooling apparatus in the power transmission system of the boat propulsion unit according to claim 6, wherein a lower end portion of the water cooling passage has a substantially annular shape arranged to extend around the axis.

9. The water cooling apparatus in the power transmission system of the boat propulsion unit according to claim 6, wherein a plurality of drain holes arranged to discharge the cooling water are provided in the bottom of the transmission case to fluidly connect the lower end portion of the cooling water passage with an area below the transmission case.

* * * * *

UNITED STATES PATENT AND TRADEMARK OFFICE

CERTIFICATE OF CORRECTION

PATENT NO. : 7,892,056 B2
APPLICATION NO. : 12/345790
DATED : February 22, 2011
INVENTOR(S) : Yoshihiko Okabe et al.

It is certified that error appears in the above-identified patent and that said Letters Patent is hereby corrected as shown below:

Title page, item (75) Inventors; should read as follows:

(75) Inventors: Yoshihiko Okabe, Shizuoka (JP);
Hirotoshi Yamauchi, Shizuoka (JP)

Signed and Sealed this
Nineteenth Day of July, 2011

David J. Kappos

David J. Kappos
*Director of the United States Patent and Trademark Office*